US005826568A

United States Patent [19]

Van Ross, Jr.

[11] Patent Number: 5,826,568

[45] Date of Patent: Oct. 27, 1998

[54] BALL PITCHING APPARATUS

[75] Inventor: William Van Ross, Jr., Garland, Tex.

[73] Assignee: Dallas Metal Fabricators, Inc., Dallas, Tex.

[21] Appl. No.: 855,458

[22] Filed: May 13, 1997

[51] Int. Cl.[6] ..... F41B 4/00

[52] U.S. Cl. ..... 124/6

[58] Field of Search ..... 124/6, 78, 81

[56] References Cited

U.S. PATENT DOCUMENTS

| | | | |
|---|---|---|---|
| Re. 30,703 | 8/1981 | Paulson et al. | 124/81 X |
| 1,198,359 | 9/1916 | Kyle . | |
| 1,211,738 | 1/1917 | Marty . | |
| 2,306,613 | 12/1942 | Chesley . | |
| 3,817,235 | 6/1974 | Blake . | |
| 3,878,827 | 4/1975 | Newgarden | 124/81 |
| 4,091,791 | 5/1978 | Castelli et al. | 124/73 |
| 4,323,047 | 4/1982 | McIntosh et al. | 124/81 X |
| 4,552,120 | 11/1985 | Nall et al. . | |
| 4,583,514 | 4/1986 | Nozato | 124/78 |
| 4,672,942 | 6/1987 | Steward . | |
| 4,705,014 | 11/1987 | Kahelin | 124/81 X |
| 4,765,618 | 8/1988 | Daley . | |
| 4,841,945 | 6/1989 | Braden | 124/78 |
| 4,883,272 | 11/1989 | Lay | 124/81 X |
| 5,012,790 | 5/1991 | Bates | 124/81 |
| 5,014,677 | 5/1991 | Gagnon | 124/6 |
| 5,396,876 | 3/1995 | Liscio et al. | 124/6 |
| 5,437,261 | 8/1995 | Paulson et al. | 124/78 |

OTHER PUBLICATIONS

Product catalog pp. 56–57, Bulldog Pitching Machine (no date).

*Primary Examiner*—John A. Ricci

*Attorney, Agent, or Firm*—Randall C. Brown; Rick Matos; Akin, Gump, Strauss, Hauer & Feld, L.L.P.

[57] ABSTRACT

A ball pitching and throwing apparatus that is readily adaptable to propelling a variety of balls, including softballs and baseballs. The apparatus provides a self-contained portable power source, portability and ease of maintenance. The ball pitching apparatus, which includes a portable body, has a stand alone power source that is engaged to a propelling wheel by way of an axle. A ball is loaded into a feeder chute which directs the ball toward a space between the outer periphery of the propelling wheel and an, optionally adjustable, propulsion alignment. Upon contact with the both the outer periphery of the propelling wheel and the propulsion alignment, the ball is propelled from the apparatus. The initial trajectory of the ball can be changed by altering the disposition of an axle mounted pivot arm upon which is mounted the propulsion alignment. A clutch mounted on the body includes an idler wheel and reciprocatingly engages and disengages the engine from the axle upon which the propelling wheel is mounted. The revolutions per minute of the wheel can be varied.

24 Claims, 5 Drawing Sheets

BALL PITCHING APPARATUS

BACKGROUND OF THE INVENTION

1. Field of the Invention

The present invention relates to a ball pitching device, and, more specifically, to a combination baseball and softball pitching machine. The ball pitching device has particular utility in connection with baseball and softball team practices.

2. Description of Related Information

Given the limitations of human ability to reproducibly throw an accurate pitch, a mechanical device to pitch and throw balls is often employed during baseball and softball practice sessions. Several ball pitching machines are known in the art. However, all of these machines exhibit certain deficiencies.

Most of the conventional ball pitching machines are designed specifically to throw baseballs, softballs or tennis balls and can not be adapted to pitch or throw more than a single type of ball. At least one conventional baseball pitching device can be adapted to pitch softballs, however, it requires a costly conversion kit which is cumbersome to install and does not easily and readily switch between the two types of balls. Such a device does not allow a school to use the same device for its baseball and softball teams.

Portability is another desirable trait for a ball pitching device. Portability is determined by three factors: power source, mobility, and ease of setup.

All ball pitching devices require a source of power. Most conventional ball pitching devices use an electric power source. The disadvantages of using electric power are obvious. Usually a long extension cord must be engaged with a source of power and then stretched out to the practice field. The cord represents a hazard to players on the field, and limits the suitable practice fields to those having a power source within reach of the extension cord. In addition, the long extension cords that are used to connect the ball pitching devices to a power source create a high current load that tends to reduce the life and reliability of the motors and speed control of such electronic pitching devices.

Some conventional ball pitching devices that use electric power depend upon a rechargeable battery. While the use of a battery allows for the elimination of the power cord, the battery must be charged each time before use and may not last an entire practice. Also, the level of power supplied by a battery tends to decay over time and use, which in turn decreases the performance of the device.

Other conventional devices known in the art use a gasoline-powered engine.

Mobility also relates to portability. Many of the conventional ball pitching devices must be carried from site to site. The devices are generally bulky and heavy, making movement undesirable. Often such devices may be left at a single site between games. This requires a cover for the device to protect it from the elements, and also poses a security risk. Some conventional devices use wheels to achieve mobility. Since significant forces and vibrations are exerted on a ball pitching device as a ball is ejected, placing such a device on a wheeled, cart-type platform is undesirable, as the forces and vibration can cause the device to jiggle and change its position, requiring the device to be readjusted periodically. At least one conventional device overcomes this deficiency by using the ball pitching wheel for movement of the device. A user of such a device inverts and rolls it from place to place. This is undesirable as the process of inversion can damage the device, and rolling the pitching wheel along a field or pavement not only exposes it to the force of the weight of the device, but also to dirt, burrs, and rocks causing premature and uneven wear, decreasing the life of the tire, and its overall performance in terms of pitching respectability.

Ease of setup is another factor of portability. Many conventional devices are mounted on a tripod. The tripod must be adjusted every time such a device is used. This is cumbersome, and often requires a significant amount of time to adjust the device to pitch the balls into the strike zone.

A need exists, therefore, for a device that can readily adapt to different types of balls, offers a reliable source of power, and is easy to move and setup.

SUMMARY OF THE INVENTION

The device of the present invention overcomes the above-mentioned disadvantages and deficiencies which are characteristic of the prior art. The apparatus of the present invention also has the further advantages of being relatively simple and economical, making it more accessible to the public. The apparatus of the present invention has still further advantages of being capable of outside use at a location far from a source of electricity.

The present invention employs readily interchangeable feeders, e.g. feed tubes of different diameters, for pitching or propelling a variety of balls, e.g. baseballs and softballs, or objects. The use of such a feed tube not only allows baseball and softball leagues and teams to share a single device, it also allows a parent or coach to change between ball types at a single practice, allowing multiple athletic supervision. Further, other feed tube diameters could be used so that the device is readily adaptable to pitch other types of balls.

The apparatus of the present invention uses a stand-alone power source, e.g. a gasoline-powered engine, thereby allowing it to be used in any location without the necessity of a readily available power outlet.

Thus, one aspect of the invention provides a ball pitching apparatus for propelling a ball comprising: a body;

a ball propelling wheel having an outer periphery, said wheel being rotatably mounted on an axle secured to said body and said wheel lying along a plane perpendicular to said axis;

a stand-alone power source mounted on said body and engaged with said axle for rotating said propelling wheel;

a pivot arm having a distal end, a median portion and proximal end, said median portion being pivotally secured to said axle, said pivot arm depending parallel to said plane of said propelling wheel;

a propulsion alignment means secured to said distal end of said pivot arm, said propulsion alignment means being positioned on said pivot arm to provide a defined clearance interposed said alignment means and said outer periphery of said propelling wheel;

a feeder for receiving a ball therein and for directing a ball to said defined clearance, wherein said feeder is demountably attached to said propulsion alignment means; and adjustment means attached to said proximal end of said pivot arm for securing a position of said pivot arm relative to said propelling wheel, said position of said pivot arm controlling an angle of incidence formed by said feed tube and said outer periphery of said propelling wheel.

The apparatus of the present invention also has a single pair of transport wheels mounted at the base of the body adjacent the ground, in a manner similar to a dolly. This provides ease of movement to the apparatus while also allowing for greater stability than a cart-type wheeled structure. Immobilization means, e.g. pair of cleated feet, are also located at the base of the apparatus so that the apparatus remains stable and immobile during use despite the forces of motor vibration and ball ejection reaction.

The dolly body of the apparatus of the present invention also provides for ease of setup. No major adjustments are required once the apparatus is placed in a desired position. The interchangeable feed tubes, discussed above, mount easily. Further, a simple pivot mechanism allows the height of the balls pitched by the apparatus of the present invention to be readily adjusted, and also allows the pitching device to simulate fly balls and other hits and throws, so that it may be utilized for fielding as well as batting practice.

Accordingly, another aspect of the invention provides a ball pitching apparatus for propelling at least one of a ball and object, comprising:

a body having a base;

a propelling wheel having an outer periphery, said wheel being rotatably mounted on an axle secured to said body and lying along a plane perpendicular to said axle;

a gasoline-powered engine mounted to said body and engaged with said axle for rotating said propelling wheel;

a clutch adjustably mounted on said body for reciprocatingly engaging and disengaging said propelling wheel from said engine;

a pivot arm having a distal end, a median portion and a proxinmal end, said median portion being pivotally secured to said axle, said pivot arm depending parallel to said plane of said propelling wheel;

a propulsion alignment plate secured to said distal end of said pivot arm, said propulsion alignment plate being positioned on said pivot arm to provide a defined clearance interposed said alignment plate and said outer periphery of said propelling wheel;

a user-mountable and replaceable feed tube adjacent said propulsion alignment plate for receiving and for directing toward said defined clearance at least one of a ball and an object;

adjustment means attached to said proximal end of said pivot arm for securing a position of said pivot arm relative to said propelling wheel, wherein said position of said pivot arm defines an angle of incidence formed by said user-mountable feed tube and said outer periphery of said propelling wheel;

a sway bar secured to said axle and to said propulsion alignment plate;

a transport wheel attached to said base of said body for transporting said apparatus; and an immobilization means attached to said base of said body and horizontally juxtaposed said transport wheel for immobilizing said apparatus during use.

Additional features and advantages of the present invention will be readily apparent to those of ordinary skill in the art upon a reading of the following detailed description of presently preferred, but nonetheless illustrative, embodiments of the present invention when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings.

DESCRIPTION OF THE PREFERRED EMBODIMENTS

Figure 1:
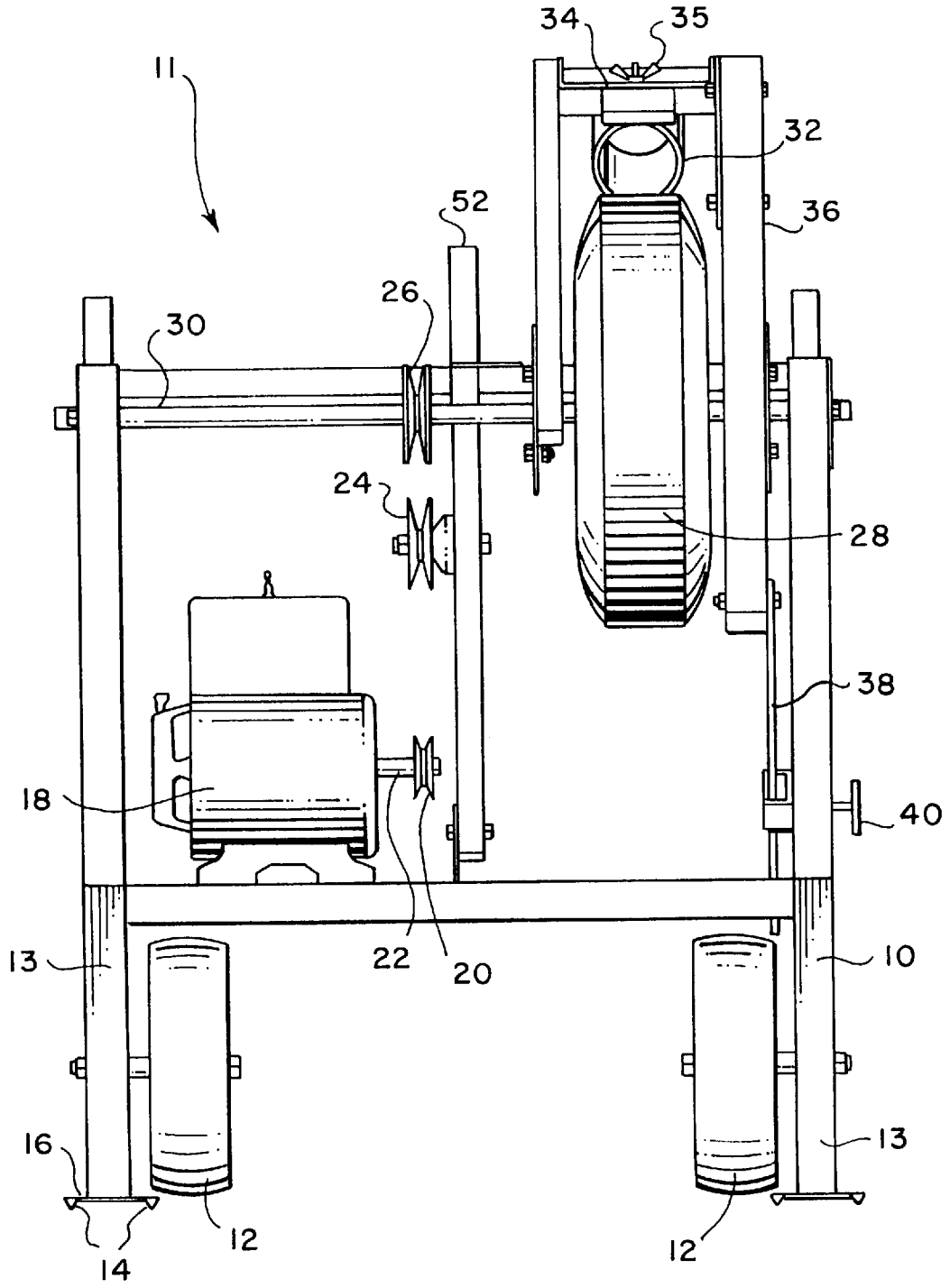
FIG. 1 is a front elevation of a preferred embodiment of the ball pitching apparatus of the present invention.

Referring now to the drawings, a preferred embodiment of the ball pitching apparatus of the present invention is generally indicated in FIG. 1.

As shown in FIG. 1, the ball pitching apparatus 11 of the present invention includes a body 10 that provides a basic support structure for the apparatus. The body 10 preferably comprises a metal frame cart which provides a rigid support structure for the apparatus. A pair of transport wheels 12 preferably are attached to the body 10 to allow the apparatus to be moved easily. Also, a pair of feet 16 offer stability to the apparatus by allowing the apparatus to be immobilized or stabilized, e.g. firmly staked into the ground. The combination of transport wheels 12 and cleated feet 16 allow the ball pitching device to be tilted and rolled akin to a dolly.

The immobilization means of the invention will be mounted on the legs 13, i.e. the base, of the body 10 horizontally juxtaposed the transport wheels 12 along the surface upon which the pitching apparatus is being used. For some surfaces, other immobilization means will be needed to render the pitching apparatus immobile or stabilized when operated. The invention contemplates that brakes (not shown) can be used to control or stop the rotation of the transport wheels 12. It is also contemplated that step-on stakes (not shown) can be vertically and slidably affixed to legs 13 of the body 10 in order to permit secure immobilization of the ball pitching apparatus during use.

Figure 3:
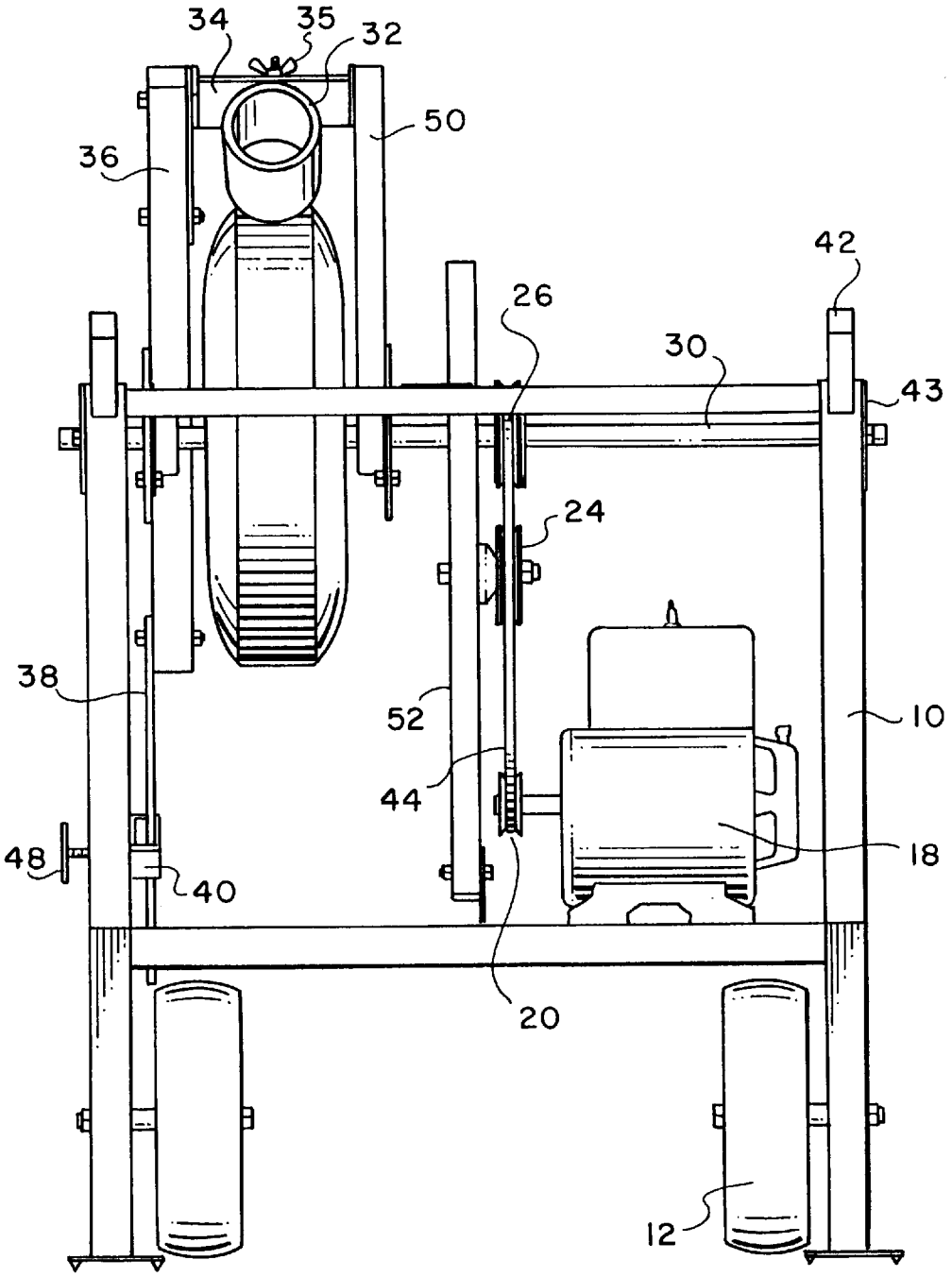
FIG. 3 is a rear elevation of the device.
Figure 4:
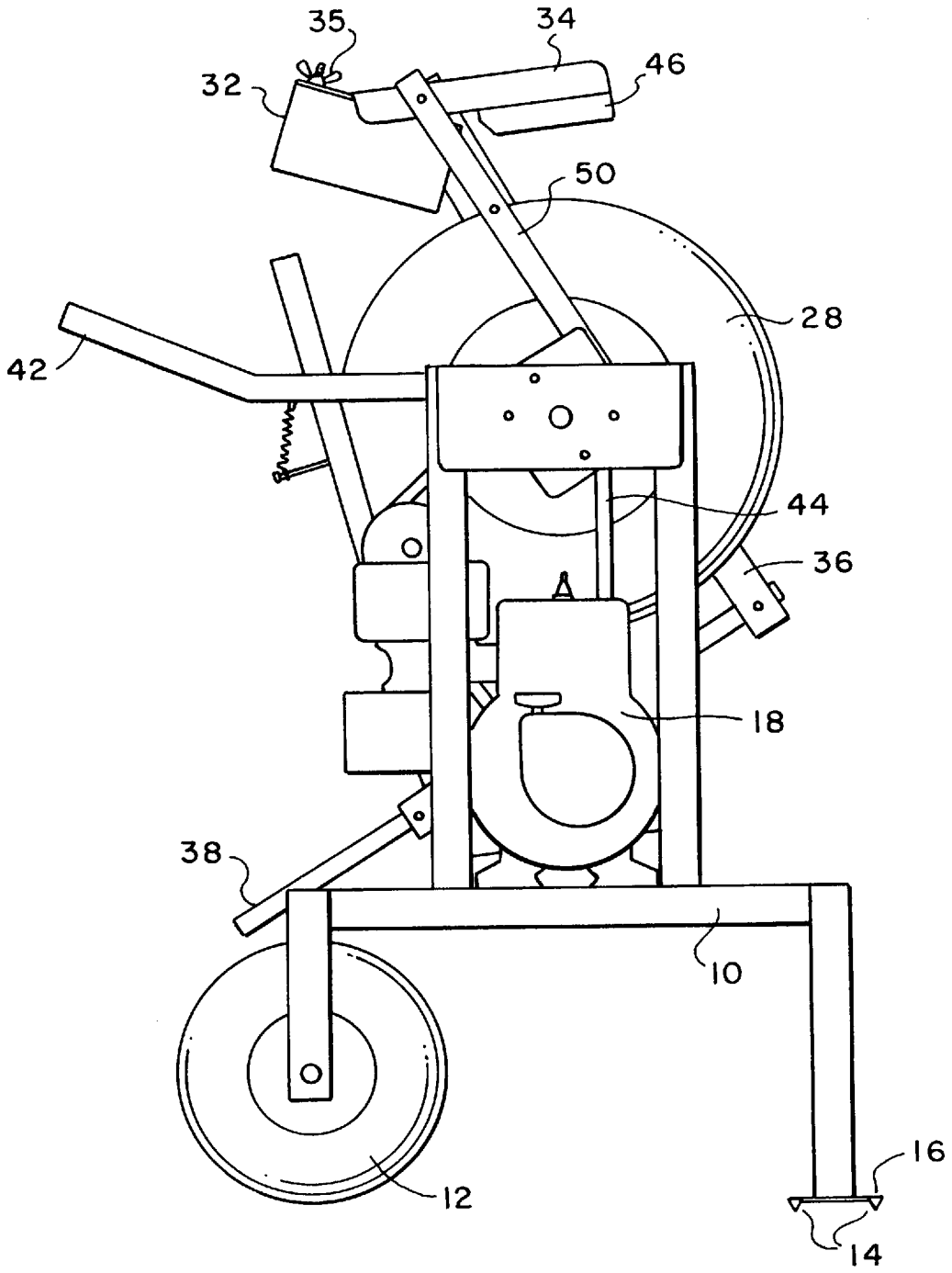
FIG. 4 is a power-side elevation of the device.

A gasoline-powered engine 18 preferably is mounted on the body 10. The gasoline-powered engine 18 is mounted on the body 10 preferably with rubber or another type of shock absorbing material disposed between the engine 18 and the body 10 to reduce noise and vibration. The gasoline-powered engine 18 preferably is of the type commonly found on a lawn mower. The gasoline-powered engine 18 provides a lightweight source of portable power. The engine 18 has a crankshaft 22 and an engine pulley 20 attached to the distal end of the crankshaft 22. As shown in FIG. 3, a belt 44 is engaged with the engine pulley 20 and is also engaged with an idler pulley 24 and a variable-pitch axle pulley 26.

The gasoline-powered engine 18 of the invention can be considered an independent, stand-alone power source. Such a stand-alone power source is portable with the ball pitching apparatus and does not need a stationary power source such as an electrical outlet. Exemplary power sources contemplated by the invention include natural gas-, alcohol-, diesel-, gasoline-, oil-, photovoltaic cell- and/or battery-powered motors and engines.

A propelling wheel 28 is rotatably mounted on an axle 30 which axle 30 is mounted or secured to the body 10 of the apparatus. Preferably the axle 30 is mounted to the body 10 with a rubber enclosed bearing or grommet at each end thereof The variable-pitch axle pulley 26 is mounted on the axle 30 thereby allowing the drive belt 44 to turn the propelling wheel 28. Thus, the engine drives the axle 30 through a rubber drive belt 44 which further isolates the propelling wheel 28 from the vibration of the engine 18.

In a preferred embodiment of the present invention, the propelling wheel 28 is a pneumatic tire. The use of a tire provides resilience against minor damage and allows a replacement propelling wheel 28 to be easily located. In addition, those of ordinary skill in the art will recognize that the accuracy of the ball propelled from the ball pitching apparatus may be improved and the noise and vibration of the apparatus may be decreased by periodically balancing the propelling wheel 28 on a tire truing balancing machine. Further, those of ordinary skill in the art will recognize that locating the gasoline-powered engine 18 remotely from the propelling wheel 28 tends to reduce the noise and vibration generated by the engine 18 as well as to increase the accuracy of the ball propelled from the apparatus.

A feed tube 32, preferably a piece of PVC pipe, is removably mounted to a plate 34 and is held in place by a fastener 35, preferably a bolt and wing-nut combination.

Since the feed tube 32 is simply mounted to the apparatus 10 by means of a bolt and wing-nut combination fastener 35, feed tubes 32 of different diameters that can accommodate balls of differing diameter can be readily interchanged by a quick manual process.

Although the feeder is depicted in the attached drawings as the feed tube 32, it is contemplated that other feeders which can receive an object or ball and direct it toward the defined clearance interposed the outer periphery of the propelling wheel 28 and the propulsion alignment pad 46 can be used. Thus, exemplary feeders of the invention include a tube, chute, channel and trough. When feeders such as the latter three are used, it may not be necessary to change the feed structure when pitching a variety of different size balls. The feeder of the invention is intended to be user removable, replaceable or interchangeable.

Figure 2:
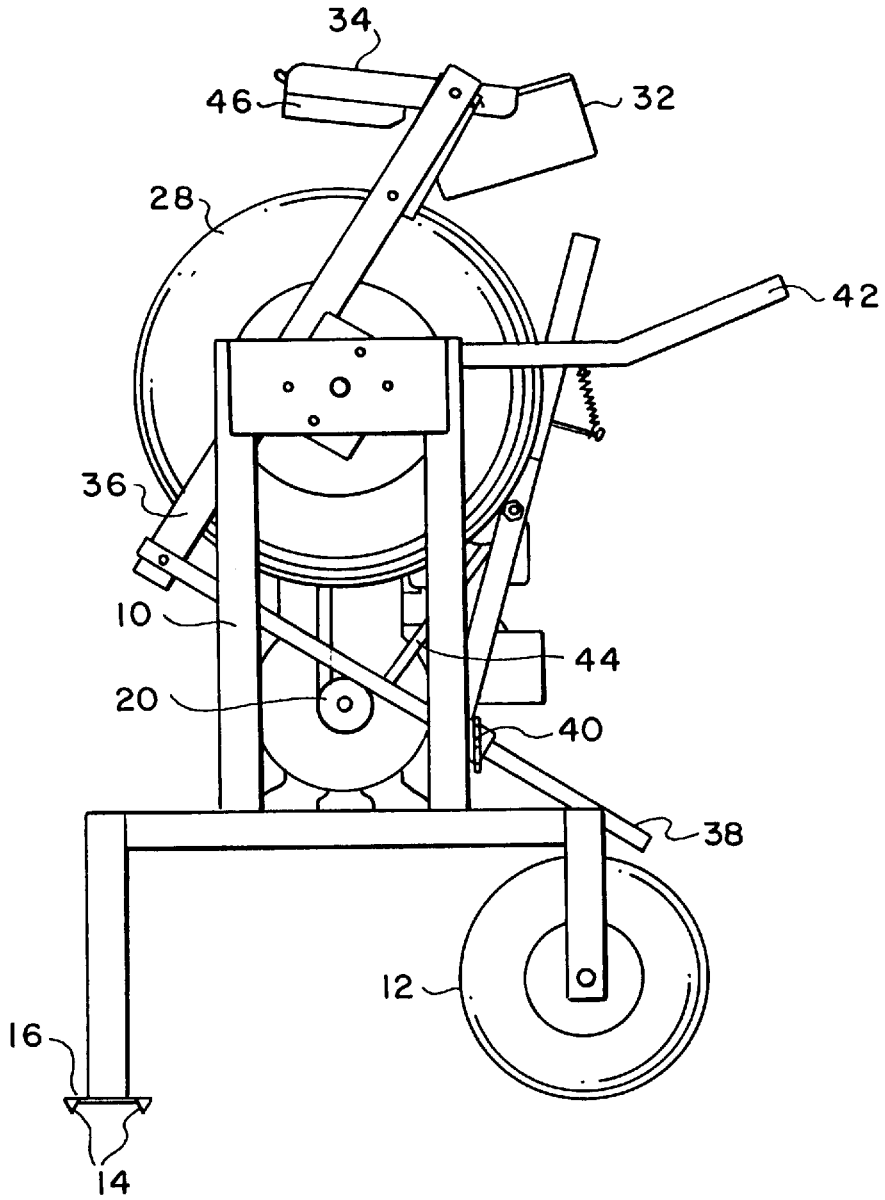
FIG. 2 is a throwing-side elevation of the device.

As shown in FIG. 2, the mounting plate 34 is attached to a distal end of pivot arm 36. The proximal end of pivot arm 36 is in turn linked to an adjusting arm 38. The median portion of pivot arm 36 is secured to the axle 30. The pivot arm 36 depends from the axle 30 and is parallel to the radial plane of the propelling wheel 28. The pivot arm 36 allows a pitch angle to be adjusted over a wide range, so that the apparatus can deliver not only a variety of pitches, but also can be used as a general throwing device for purposes such as outfield practice. An adjustment means, comprised of an angular adjustment clamp 40, locks the adjusting arm 38 and pivot arm 36 in place by securing the adjusting arm 38 to the body 10, ensuring reproducibility from pitch to pitch.

As shown in FIGS. 2 and 3, a handle 42 extends from an upper portion 43 of the body 10. The handle 42 allows the apparatus 10 to be tilted back upon the transport wheels 12 and rolled from place to place with ease.

As shown in FIG. 2, a propulsion alignment pad 46 is affixed to the underside of the propulsion alignment plate 34 opposite the feed tube 32. The propulsion alignment pad 46, which is preferably comprised of rubber, provides an upper limit of projection for a ball to be expelled from the feed tube 32 and thus defines the flight path of the ball.

The propulsion alignment means of the invention is depicted in the attached figures as a pad 46; however, it can be any resilient propulsion alignment structure which aligns a ball or object received from the feed tube 32 and cooperates with the outer periphery of the propelling wheel 28 to propel said ball or object. The propulsion alignment means together with the outer periphery of the propelling wheel provides a defined clearance interposed the same. Exemplary propulsion alignment means such as rollers, bearings, tires, plastic plates, foam pads, rubber pads, and metal plates can be used.

The pivot arm 36 and the propulsion alignment pad 46 may be adjusted in fine increments, thereby varying the path of a ball thrown by the apparatus 11, allowing a variety of pitches and even fly-balls to be performed by the apparatus 11.

As shown in FIG. 3, an adjustment means, for securing a position of said pivot arm 36, comprises the adjusting clamp screw handle 48, the angular adjustment clamp 40, and the adjusting arm 38. Said screw handle 48, adjustment clamp 40, and adjusting arm 38 cooperate to provide a user control over pivot arm 36 position.

Also as shown in FIG. 3, a sway bar 50 is attached to the mounting plate 34 opposite the pivot arm 36. The sway bar 50 provides further stability to the mounting plate 34.

FIG. 3 also illustrates the drive mechanism of the invention. The idler pulley 24 is located on a clutch, or idler arm 52. The clutch 52 is pivotally mounted to the body 10, and may be readily adjusted by reciprocation, so as to increase or decrease the tension of the belt 44 mounted on the idler pulley 24. A user of the device can thereby control or adjust the revolutions per minute of the propelling wheel 28: when the belt 44 is tight, the ball will be propelled from the apparatus with greater speed than when the belt 44 is loose.

Another method of adjusting the revolutions per minute of the propelling wheel is provided by the variable pitch axle pulley 26 which is mounted on the axle 30 and which has an adjustable gap. By varying the width of the gap of the variable pitch axle pulley 26, the belt 44 is allowed to travel closer to, or be pushed further from, the axle 30. This allows for fine adjustment of belt tightness, allowing not only for fine tuning of the revolutions per minute of the propelling wheel 28 and, consequently, pitching speed, but also allows for slight variations in the length of the belt 44 and allows slightly stretched belts 44 to be used, thereby prolonging the life of the belt 44.

A throttle associated with the power source of the invention can be employed as yet another means to control the revolutions per minute of the propelling wheel 28 and thus a ball propelled by the apparatus.

Figure 5:
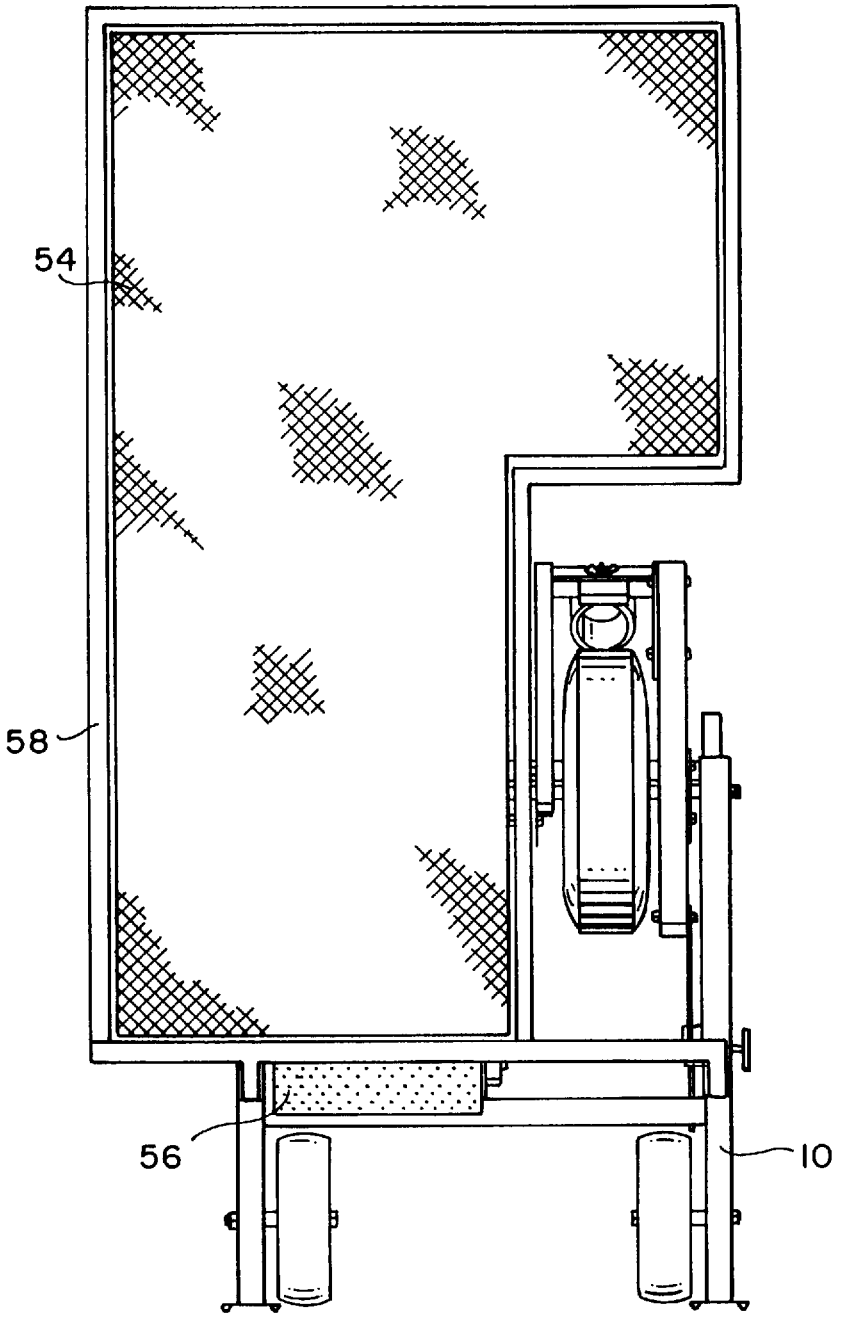
FIG. 5 displays an alternative embodiment of a ball pitching device which further comprises a safety net.

An alternate embodiment of the apparatus 10 of the present invention is shown in FIG. 5. According to this embodiment, the apparatus includes a protective screen, such as a safety net 54, and an engine housing 56. In particular embodiments, the safety net 54 is secured to a net frame 58 which in turn is secured to the body 10 of the apparatus. Preferably, the safety net 54 is a nylon mesh net mounted to the front of the device, and protects a user of the apparatus from balls hit by a batter towards the apparatus. The protective screen can be transparent, semi-transparent or opaque. It can also be made of, for example, a cloth, string or rope mesh, a metal grid or sheet metal.

The engine housing 56 surrounds the engine 18 and is attached to the body 10 of the apparatus. Preferably, the engine housing 56 is comprised of sheet metal plates. The engine housing 56 provides additional safety by shielding elements of the belt drive, preventing the belt 44 from grabbing any loose clothing or other objects dangling from a user. The engine housing 56 also protects the engine 18 from balls hit by a batter towards the apparatus. Additionally, the engine housing 56 provides noise dampening, quieting the sound of the engine.

The ball pitching apparatus of the invention can be used to pitch, throw, hurl, toss, fling, lob or otherwise propel any ball or object provided said ball or object can contact both the outer periphery of the propelling wheel 28 and the propulsion alignment structure upon exiting the feeder. In particular embodiments, such balls or objects include baseballs, softballs, tennis balls, racquetball balls, handball balls, rocks, beach balls and large marbles.

While preferred embodiments of the present invention have been shown and described, it will be understood by those skilled in the art that substitutions of materials and various changes and modifications may be made without departing from the spirit and scope of the invention which is defined by the appended claims.

The above is a detailed description of particular embodiments of the invention. Those with skill in the art should, in light of the present disclosure, appreciate that obvious modifications of the embodiments disclosed herein can be made without departing from the spirit and scope of the invention. All of the embodiments disclosed and claimed herein can be made and executed without undue experimentation in light of the present disclosure. The full scope of the invention is set out in the claims that follow and their equivalents. Accordingly, the claims and specification should not be construed to unduly narrow the full scope of protection to which the present invention is entitled.

As used herein, the terms "a" and "an" are taken to mean "one" or "at least one".

What is claimed is:

1. Ball pitching apparatus for propelling a ball comprising:

a body;

a ball propelling wheel having an outer periphery, said wheel being rotatably mounted on an axle secured to said body and said wheel lying along a plane perpendicular to said axle;

a stand-alone power source mounted on said body and engageable with said axle for rotating said propelling wheel;

a clutch adjustably mounted on said body for reciprocating engaging and disengaging said ball propelling wheel from said stand alone power source, wherein said clutch comprises an idler pulley attached thereto and coupled between said stand alone power source and said propelling wheel;

a pivot arm having a distal end, a median portion and proximal end, said median portion being pivotally secured to said axle, said pivot arm depending parallel to said plane of said propelling wheel;

a propulsion alignment means secured to said distal end of said pivot arm, said propulsion alignment means being positioned on said pivot arm to provide a defined clearance interposed between said propulsion alignment means and said outer periphery of said propelling wheel;

a feeder for receiving a ball therein and for directing a ball to said defined clearance, wherein said feeder is demountably attached to said propulsion alignment means; and adjustment means attached to said proximal end of said pivot arm for securing a position of said pivot arm relative to said propelling wheel, said position of said pivot arm controlling an angle of incidence formed by said feeder and said outer periphery of said propelling wheel.

2. The apparatus of claim 1 wherein said feeder is one of a tube, channel, trough and chute.

3. The apparatus of claim 2 wherein said feeder is a tube having an interior diameter slightly greater than the outside diameter of a ball being propelled.

4. The apparatus of claim 1 further comprising at least one wheel attached to said body for transporting said apparatus.

5. The apparatus of claim 1 further comprising a plurality of wheels mounted on said body for transporting said apparatus.

6. The apparatus of claim 5 further comprising immobilization means mounted on the base of said body horizontally juxtaposed said plurality of wheels.

7. The apparatus of claim 6 wherein said immobilization means comprises a cleated foot.

8. The apparatus of claim 1 further comprising a sway bar, wherein said sway bar is secured to said axle and to said propulsion alignment means.

9. The apparatus of claim 1 further comprising a protective screen secured to said body for protecting a user of the apparatus.

10. The apparatus of claim 1 further comprising a throttle coupled to said power source for varying the revolutions per minute of said propelling wheel.

11. The apparatus of claim 1, wherein said power source is mounted on said body with shock absorbing material to reduce noise and vibration.

12. The apparatus of claim 1, wherein said power source is a gasoline-powered engine and said engine is engaged to said propelling wheel by a belt-driven pulley system.

13. The apparatus of claim 1, wherein the propulsion alignment means is a propulsion alignment plate.

14. The apparatus of claim 1 wherein said feeder can accommodate a ball having a diameter of one of a baseball and a softball.

15. The apparatus of claim 1 wherein the defined clearance interposed between said propulsion alignment means and said outer periphery of said propelling wheel can accommodate one of a baseball and a softball.

16. Ball pitching apparatus for propelling a ball comprising:

a body;

a ball propelling wheel having an outer periphery, said wheel being rotatably mounted on an axle secured to said body and said wheel lying along a plane perpendicular to said axle;

a stand-alone power source mounted on said body and engageable with said axle for rotating said propelling wheel;

a clutch adjustably mounted on said body for reciprocatingly engaging and disengaging said ball propelling wheel from said stand alone power source, wherein said clutch comprises an idler pulley attached thereto and coupled between said stand alone power source and said propelling wheel;

a pivot arm having a distal end, a median portion and proximal end, said median portion being pivotally secured to said axle, said pivot arm depending parallel to said plane of said propelling wheel;

a propulsion alignment means secured to said distal end of said pivot arm, said propulsion alignment means being positioned on said pivot arm to provide a defined clearance interposed between said propulsion alignment means and said outer periphery of said propelling wheel;

a feeder for receiving a ball therein and for directing a ball to said defined clearance, wherein said feeder is demountably attached to said propulsion alignment means;

adjustment means attached to said proximal end of said pivot arm for securing a position of said pivot arm relative to said propelling wheel, said position of said pivot arm controlling an angle of incidence formed by said feeder and said outer periphery of said propelling wheel; and a variable pitch adjustable pulley coupled between said stand alone power source and said propelling wheel for varying the revolutions per minute of said propelling wheel.

17. A ball pitching apparatus for propelling at least one of a ball and object, comprising:

a body having a base;

a propelling wheel having an outer periphery, said wheel being rotatably mounted on an axle secured to said body and lying along a plane perpendicular to said axle;

a gasoline-powered engine mounted to said body and engaged with said axle for rotating said propelling wheel;

a clutch adjustably mounted on said body for reciprocatingly engaging and disengaging said propelling wheel from said engine, wherein said clutch comprises an idler pulley attached thereto and coupled between said engine and said propelling wheel;

a pivot arm having a distal end, a median portion and a proximal end, said median portion being pivotally secured to said axle, said pivot arm depending parallel to said plane of said propelling wheel;

a propulsion alignment plate secured to said distal end of said pivot arm, said propulsion alignment plate being positioned on said pivot arm to provide a defined clearance interposed between said alignment plate and said outer periphery of said propelling wheel;

a user-mountable and replaceable feed tube adjacent said propulsion alignment plate for receiving and for directing toward said defined clearance at least one of a ball and an object;

adjustment means attached to said proximal end of said pivot arm for securing a position of said pivot arm relative to said propelling wheel, wherein said position of said pivot arm defines an angle of incidence formed by said user-mountable feed tube and said outer periphery of said propelling wheel;

a sway bar secured to said axle and to said propulsion alignment plate;

a transport wheel attached to said base of said body for transporting said apparatus; and an immobilization means attached to said base of said body and horizontally juxtaposed said transport wheel for immobilizing said apparatus during use.

18. The apparatus of claim 17 further comprising a protective screen secured to said body of said apparatus for protecting a user thereof.

19. The apparatus of claim 18, wherein the protective screen comprises a net and a net frame.

20. The apparatus of claim 17, wherein said engine is mounted to said body with shock absorbing material to reduce noise and vibration.

21. The apparatus of claim 17, wherein said immobilization means comprises a cleated foot.

22. The apparatus of claim 17 wherein said feed tube directs toward said defined clearance one of a baseball and a softball.

23. The apparatus of claim 17 wherein the defined clearance interposed between said propulsion alignment plate and said outer periphery of said propelling wheel can accommodate one of a baseball and a softball.

24. A ball pitching apparatus for propelling at least one of a ball and object comprising:

a body having a base;

a propelling wheel having an outer periphery, said wheel being rotatably mounted on an axle secured to said body and lying along a plane perpendicular to said axle;

a gasoline-powered engine mounted to said body and engaged with said axle for rotating said propelling wheel;

a clutch adjustably mounted on said body for reciprocatingly engaging and disengaging said propelling wheel from said engine, wherein said clutch comprises an idler pulley attached thereto and coupled between said engine and said propelling wheel;

a pivot arm having a distal end, a median portion and a proximal end, said median portion being pivotally secured to said axle, said pivot arm depending parallel to said plane of said propelling wheel;

a propulsion alignment plate secured to said distal end of said pivot arm, said propulsion alignment plate being positioned on said pivot arm to provide a defined clearance interposed between said alignment plate and said outer periphery of said propelling wheel;

a user-mountable and replaceable feed tube adjacent said propulsion alignment plate for receiving and for directing toward said defined clearance at least one of a ball and an object;

adjustment means attached to said proximal end of said pivot arm for securing a position of said pivot arm relative to said propelling wheel, wherein said position of said pivot arm defines an angle of incidence formed by said user-mountable feed tube and said outer periphery of said propelling wheel;

a sway bar secured to said axle and to said propulsion alignment plate;

a transport wheel attached to said base of said body for transporting said apparatus;

an immobilization means attached to said base of said body and horizontally juxtaposed said transport wheel for immobilizing said apparatus during use; and a variable pitch adjustable pulley coupled between said engine and said propelling wheel for varying a speed of said wheel.

* * * * *

UNITED STATES PATENT AND TRADEMARK OFFICE

CERTIFICATE OF CORRECTION

PATENT NO. : 5,826,568

DATED : October 27, 1998

INVENTOR(S) : William Van Ross, Jr.

It is certified that error appears in the above-indentified patent and that said Letters Patent is hereby corrected as shown below:

Column 3, line 30, change "proxinmal" to -- proximal --.

Column 4, line 63, after "thereof" insert a period.

Signed and Sealed this

Eleventh Day of May, 1999

*Attest:*

Q. TODD DICKINSON

*Attesting Officer*

*Acting Commissioner of Patents and Trademarks*